United States Patent [19]

Bell

[11] Patent Number: 4,924,616

[45] Date of Patent: May 15, 1990

[54] PORTABLE FIREARM REST

[76] Inventor: Ross A. Bell, 311 Frobisher Court, Saskatoon, Saskat Chewan, Canada, S7K 4Y3

[21] Appl. No.: 328,295

[22] Filed: Mar. 24, 1989

[51] Int. Cl.[5] ..... F41C 29/00
[52] U.S. Cl. ..... 42/94
[58] Field of Search ..... 42/94; 89/37.04

[56] References Cited

U.S. PATENT DOCUMENTS

| | | | |
|---|---|---|---|
| 882,988 | 3/1908 | Aloyos et al. | 89/37.04 |
| 1,367,353 | 2/1921 | Craig . | |
| 1,457,407 | 6/1923 | Stokes . | |
| 2,582,140 | 1/1952 | Leek | 73/167 |
| 2,599,625 | 6/1952 | Leek | 89/43 |
| 2,729,975 | 1/1956 | Hawthorne et al. | 89/37.04 |
| 2,877,689 | 3/1959 | Pribis | 42/94 |
| 3,012,350 | 12/1961 | Wold | 42/94 |
| 3,805,608 | 4/1974 | Schmidt | 73/167 |
| 3,827,172 | 8/1974 | Howe | 42/94 |
| 3,935,657 | 2/1975 | Wade | 42/94 |
| 4,026,057 | 5/1977 | Cady | 42/94 |
| 4,207,699 | 6/1980 | Hensley | 42/94 |
| 4,409,751 | 10/1983 | Goda | 42/94 |

OTHER PUBLICATIONS

Advertisement for Varminter TM Rifle Rest, author, title, date, page-unknown, date believed 1988.

*Primary Examiner*—Charles T. Jordan
*Attorney, Agent, or Firm*—Robert Bailey

[57] ABSTRACT

The portable firearm rest of the invention comprises a T shaped base, adjustable height support posts for elevation control, are positioned at the points of the T. The fore rest is a resilient pad supported on adjustable posts above the cross of the T, to receive the firearm barrel. A recoil slide with adjustable recoil spring is slidably mounted within the upright of the T, and mounts the aft rest in one embodiment comprising a vertical plate with opposed resilient bumpers to receive the firearm butt, in an alternative embodiment for heavier weapons comprising a U shaped plate with a cross bolt bearing internal opposed resilient bumpers to receive the firearm butt. Friction control is provided by a set screw engaging the recoil slide. The rest can be used for zeroing or sighting firearms, and as a shooting rest. Not only is recoil significantly reduced, but the sighting procedure is made much more convenient. The rest can be used for hand guns. An accessory is provided for use with hand guns, which has a butt rest, adjustable support and a clamp to fit the upright of the T. The elevation support posts are preferably rubber tipped.

20 Claims, 6 Drawing Sheets

PORTABLE FIREARM REST

This invention relates to portable gun rests.

Gun rests are known, and have three basic applications, which are test firing firearms for quality control, zeroing or sighting firearms for target shooting, and shooting at targets, however defined. The test firing devices are intended to replace human test shooters, the others to be used by shooters.

PRIOR ART

U.S. Pat. No. 1,367,353 issued Feb. 1, 1921 to Craig, teaches a firearm testing device, comprising a rigid bench mounting a fixed fore rest and a slidable aft rest, further connected to the bench by a recoil absorbing spring, having a recoil measuring attachment. U.S. Pat. No. 1,457,407 issued June 5, 1923 to Stokes, teaches a firearm testing device, comprising a cradle having fixed fore and aft rests, mounted slidably in an adjustable wall mounted bracket, means are provided to absorb the cradle recoil. U.S. Pat. No. 2,582,140 issued Jan. 8, 1952 to Leek, teaches a rigid support resiliently mounting a fore rest articulated to a resilient aft rest mounted on an aft cradle, the aft cradle is mounted on a rocker rotatable in a vertical plane, having a counter weight and counter spring to absorb recoil, this device is intended to simulate a human shooter. U.S. Pat. No. 2,599,265 issued June 3, 1952 to Leek, teaches a rigid cradle including fore and aft rests slidably mounted in a rigid support, the recoil is dissipated by a resilient rubber block and an air motor, this device is intended to measure and test firearm firing characteristics, during passage of the bullet through the barrel, the firearm is in free motion.

U.S. Pat. No. 3,012,350 issued Dec. 12, 1961 to Wold, teaches an adjustable fore bench pedestal rest for sighting firearms, which is used in conjunction with sandbags, or similar cushioning for zeroing the firearm. U.S. Pat. No. 3,805,608 issued Apr. 23, 1974 to Schmidt et al., teaches a rifle zeroing device comprising a rectangular rigid base mounting a rigid fore rest and paired front and aft bearings carrying two parallel recoil bars, aft of the aft bearings the recoil bars carry an aft rest, springs between collars on the recoil bars and the aft bearings absorb the recoil. The rests can clamp the rifle U.S. Pat. No. 3,985,657 issued Feb. 3, 1975 to Wade, teaches a grooved block for a rifle rest, which has means at one end of the block to adjust the elevation of the block with respect to a substrate. U.S. Pat. No. 4,207,699 issued Jun. 17, 1980 to Hensley, teaches a flat base with one adjustable leg, bearing a resilient pad having at the front end an adjustable V-rest for a rifle or pistol. U.S. Pat. No. 4,409,751 issued Oct. 18, 1989 to Goda et al. teaches an adjustable rifle rest which has fore and aft rests mounted on height adjustable pedestals, connected by paired rods on which the rear pedestal is slidably engageably movable. Varminter (T.M.), as advertised, shows a T shaped base, lockably swivelably mounting in the long arm of the T a pedestal supporting an aft arm supporting an adjustable aft rest, and a fore arm itself adjustable in elevation, supporting an adjustable fore rest.

None of the above devices provide a portable recoil absorbing gun rest.

It is an object of the invention to provide a portable recoil absorbing gun rest, other objects will become apparent.

DESCRIPTION OF THE INVENTION

In a broad aspect the invention comprises an improvement in a portable firearm rest comprising base means, a plurality of support post means projecting downward from the base, the post support means being adapted to contact a substrate, fore rest means attached to fore rest support means mounted on the base, the improvement comprising aft rest means attached to recoil slide means mounted slidably in recoil guide means included in the base, tension means including recoil spring means connect the recoil slide means to the base means, whereby the recoil of a firearm mounted on the portable firearm rest is absorbed by the tension means. Preferably the tension means includes tension adjusting means for the recoil spring means. Conveniently the base means comprises longitudinal aft frame means having fore and aft ends, the aft frame means including the recoil guide means, the recoil slide means having an aft portion projecting aft of the aft end of the recoil guide means, the aft portion of the recoil means bearing the aft rest means. More preferably the base comprises fore cross frame means having left and right ends and a midpoint, attached at the mid point to the fore end of the longitudinal aft frame means, the tension adjusting means comprising threaded bolt means threadably mounted within the fore cross frame means, the threaded bolt means extending inside the aft longitudinal frame and the recoil guide means, the recoil spring means being attached to the threaded bolt means, and to anchor means mounted in the recoil slide means. Additionally adjustable friction means between the recoil guide means and the recoil slide means are provided, this may comprise set screw means, which can be plastic, threaded through the recoil guide means to contact the recoil slide means, rotation of the set screw applies pressure to the recoil slide means. The recoil guide means may be longitudinal tube means forming the aft longitudinal frame means, and the recoil slide means is longitudinal tube means slidably received in the recoil guide means, square tubing is preferred, but not essential. To provide as much recoil absorption as possible, the recoil slide tube extends to the fore end of the recoil guide means in the forward position. Preferably the support posts are threaded posts rotatably threadably received in fore and aft coupling nuts, the fore coupling nuts being attached to the fore cross member adjacent the ends thereof, the aft coupling nut being attached to the aft longitudinal means adjacent the aft end thereof, whereby the support posts are adjustable in height. The fore support posts may include resilient substrate contact means, as may the aft post.

In a preferred aspect the invention is an improvement in a portable firearm rest comprising base means, a plurality of support post means projecting downward from the base, the post support means being adapted to contact a substrate, fore rest means attached to fore rest support means mounted on the base, the improvement comprising aft rest means attached to recoil slide means mounted slidably in recoil guide means included in the base, tension means including recoil spring means connecting the recoil slide means to the base means, whereby the recoil of a firearm mounted on the portable firearm rest is absorbed by the tension means, the base means comprises longitudinal aft frame means having fore and aft ends and fore cross frame means having left and right ends and a midpoint, attached at the mid point to the fore end of the longitudinal aft frame means, the longitudinal aft frame means comprising the recoil guide means, the recoil slide means having an aft portion projecting aft of the aft end of the recoil guide means, the aft portion of the recoil means bearing the aft rest means, the tension means comprising threaded bolt means threadably mounted within the fore cross frame means, the threaded bolt means extending inside the aft longitudinal frame and the recoil guide means, the recoil spring means being attached to the threaded bolt means, and to anchor means mounted in the recoil slide means, the plurality of support post means comprising left and right threaded post means rotatably threadably received in fore coupling nuts attached to fore cross frame means adjacent the ends thereof, and aft threaded post means rotatably threadably received in aft coupling nut means attached to the aft longitudinal means adjacent the aft end thereof, adjustable friction means between the recoil guide means and the recoil slide means, the friction means comprising set screw means threaded through the recoil guide means to contact the recoil slide means, the recoil guide means being longitudinal square tubing forming the aft longitudinal frame means, and the recoil slide means is longitudinal square tubing means slidably received in the recoil guide means, the recoil slide tube extending to the fore end of the recoil guide means in the forward position, the fore rest support means comprising post means mounted on the fore cross frame means, plate means attached to the support post means, resilient transverse pad means mounted on the plate means, the right, left and aft threaded support posts include resilient substrate contact means. In one preferred embodiment the aft rest means comprising aft mount plate means mounted vertically on the recoil slide means, opposed resilient bumpers mounted on opposed side faces of the mount plate secured to the mount plate by bolt means passing through the bumpers and the plate means. In an alternative preferred embodiment, the aft rest means comprising U shaped aft mount plate means mounted vertically on the recoil slide means, the aft plate means comprising opposed side walls, opposed resilient bumpers mounted internally on the opposed side walls secured to the side walls by bolt means passing through the bumpers and the side walls.

To allow the rest to be used for hand gun shooting the invention in another aspect is directed to a hand gun butt rest demountably attachable to a portable firearm rest having fore rest means and base means, comprising hand gun butt support means, base mount means, post means connecting the support means to the base mount means, and means to clamp the base mount means demountably to the portable firearm base means, whereby a hand gun can be rested on the fore rest at the barrel, and on the hand gun butt support at the butt, the clamping means can be applied to the base of a suitable firearm rest, especially that of this invention. Preferably the post means are adjustable so that the height of the hand gun butt support means above the base mount is adjustable, and the rest can be clamped to the longitudinal aft frame of the portable gun rest. The hand gun rest may provide a hand gun support means comprising a resilient pad mounted upon a plate, the plate being mounted upon vertical post means comprising threaded rod means rotatably mounted in coupling nut means, set screw means rotatably mounted in the side of the coupling nut means, the base mount comprising a top wall connecting opposed downward side walls, the coupling nut means being attached to one of the base side walls, whereby rotation of the threaded rod means adjusts the height of the plate above the coupling nut, demountable operating screw means comprising handled threaded bolt means, passing through a first unthreaded aperture in a first side wall and an opposed second aperture in a second side wall and being rotatably threadably received in the second side wall, whereby rotation of the threaded bolt adjusts the distance between the side walls to allow clamping onto a portable firearm rest.

DESCRIPTION OF THE PREFERRED EMBODIMENTS

Preferred embodiments are indicated in the drawings where:

Figure 1:
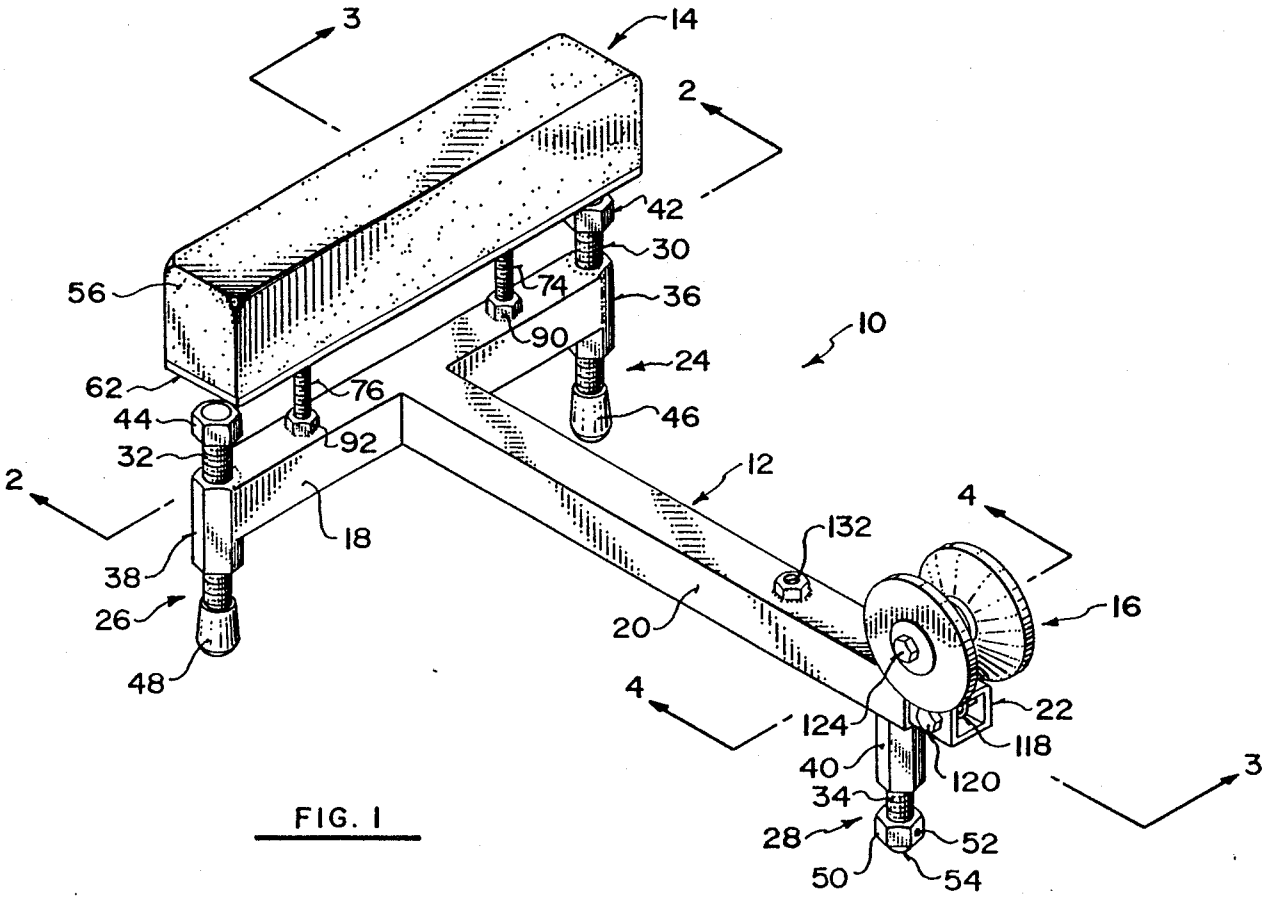
FIG. 1 shows a perspective view of an embodiment of the invention.

The gun rest is generally indicated by the numeral 10, for use on substrate 8, has base 12, fore rest 14 and aft rest 16. Base 12 has fore cross frame 18, and rear recoil guide 20, recoil slide tube 22 is slidably mounted in rear recoil guide 20. Base 12 is adjustable in height by fore right adjustment post 24, fore left adjustment post 26, and aft level adjustment post 28. The adjustment posts include threaded rods, 30 fore right, 32 fore left and 34 aft, threaded into coupling nuts, 36 fore right, 38 fore left and 40 aft, welded to cross frame 18 and rear recoil guide 20, left and right hex nuts 42 and 44 are welded (FIG. 1) or pinned (FIG. 2) to the tops of threaded rods 30 and 32 respectively to allow levelling of fore cross frame 18, and thus fore rest 14, right and left rubber feet (e.g. cane tips) 46 and 48 are fitted to the bottoms of threaded rods 30 and 32 respectively. Hex nut 50 is pinned to rear threaded rod 34 by pin 52, above rounded bottom 54 of rear threaded rod 34, this allows elevational adjustment of the rear of rear recoil guide 20 and aft rest 16.

Figure 2:
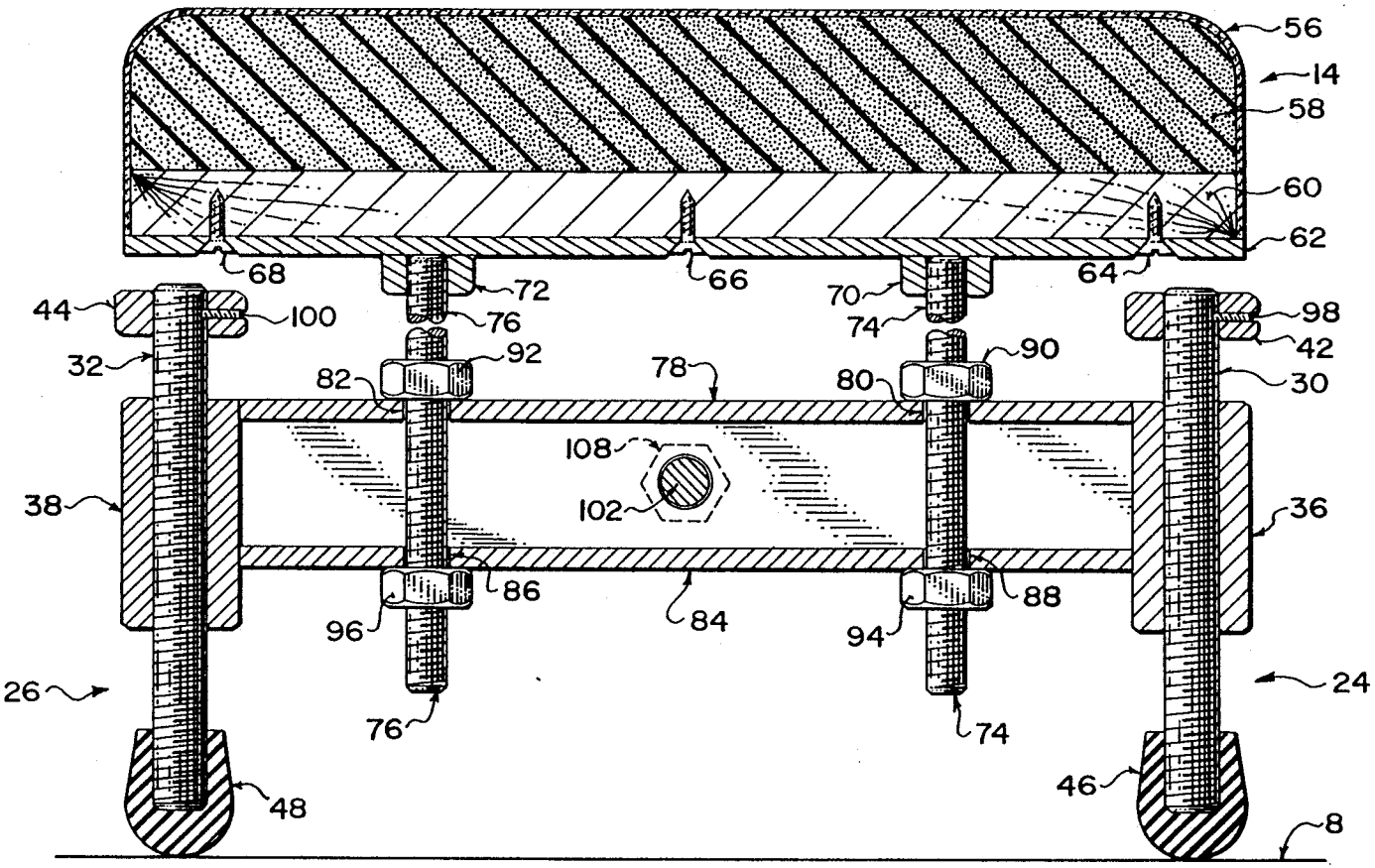
FIG. 2 shows a sectional view of a fore rest and cross frame of the invention.

Fore rest 14 has a cover 56, preferably of suede leather, over a cushion 58, preferably of foam rubber, above a wooden base 60, which is attached to metal base plate 62 by wood screws 64, 66 and 68 passing through the plate. Hex nuts 70 and 72 are welded underneath plate 62, these are threaded by rest support threaded rods 74 and 76, which pass through upper wall 78 of cross frame 18 through holes 80 and 82 and lower wall 84 of cross frame 18, through holes 86 and 88. Upper hex nuts 90 and 92 and lower hex nuts 94 and 96 adjustably secure threaded rods in position in cross frame 18. In FIG. 2, the alternative embodiment of pins 98 and 100 securing hex nuts 42 and 44 to threaded rods 30 and 32 respectively is indicated. Threaded recoil adjustment rod 102 passes between rods 74 and 76.

Figure 8:
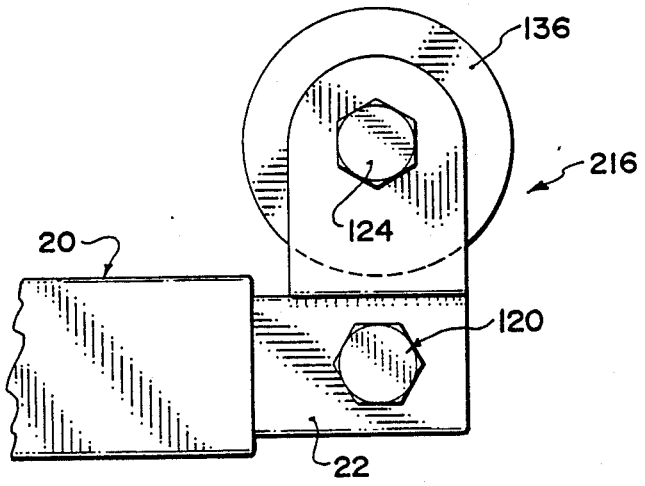
FIG. 8 shows a side view of the embodiment of FIG. 7.

Threaded recoil adjustment rod 102 at the fore end passes through hole 104 in front wall 106 of cross frame 18, where it is secured by tension adjustment hex nut 108, the aft end of rod 102 has projecting plate 110 having central hole 112, through this passes fore loop 114 of spring 116, providing a fore anchor for the spring 116, aft loop 118 of spring 116 passes around anchor bolt 120 fixed to rear slide tube 22, providing a rear anchor for the spring 116. Vertical aft rest mount plate 122 is welded on the top surface of rear slide tube 22 and has bolt 124 passing through it to mount aft rest 16. Frictional adjustment is provided by hex socket set screw 128, which can exert pressure on rear slide tube 22, through hole 180 in recoil guide 20, set screw 128 is threaded in hex nut 132 welded to recoil guide 20, allowing friction adjustment. In FIG. 8 is shown an alternative embodiment of aft level adjustment post 28, indicating rubber foot (e.g. cane tip) 126.

Figure 3:
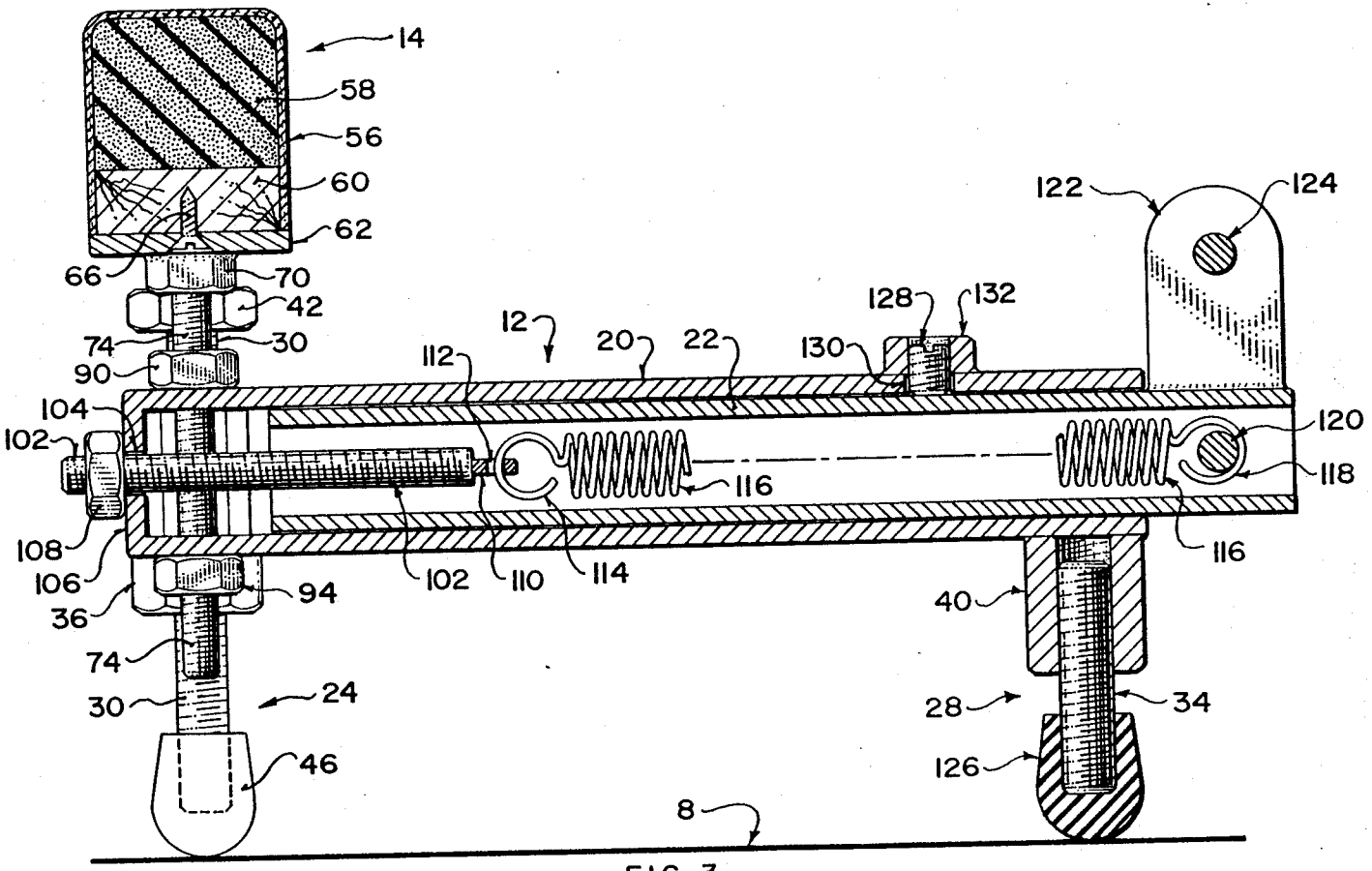
FIG. 3 shows a sectional view of a rear recoil guide, recoil slide tube and assembly of the invention.
Figure 4:
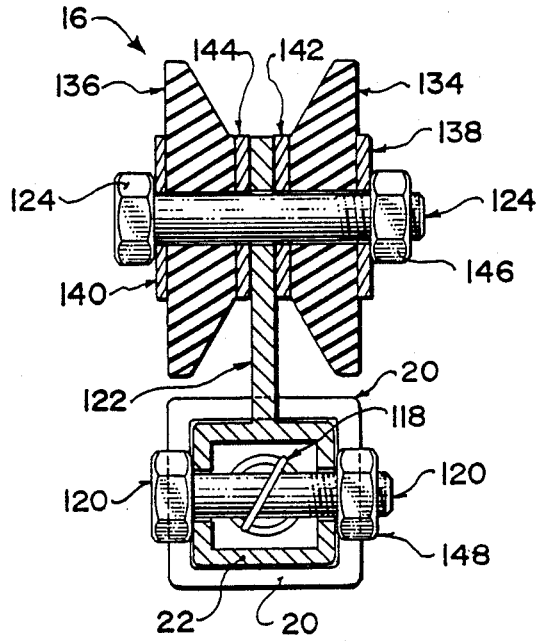
FIG. 4 shows a sectional view of an embodiment of an aft rest mounting of the invention.
Figure 5:
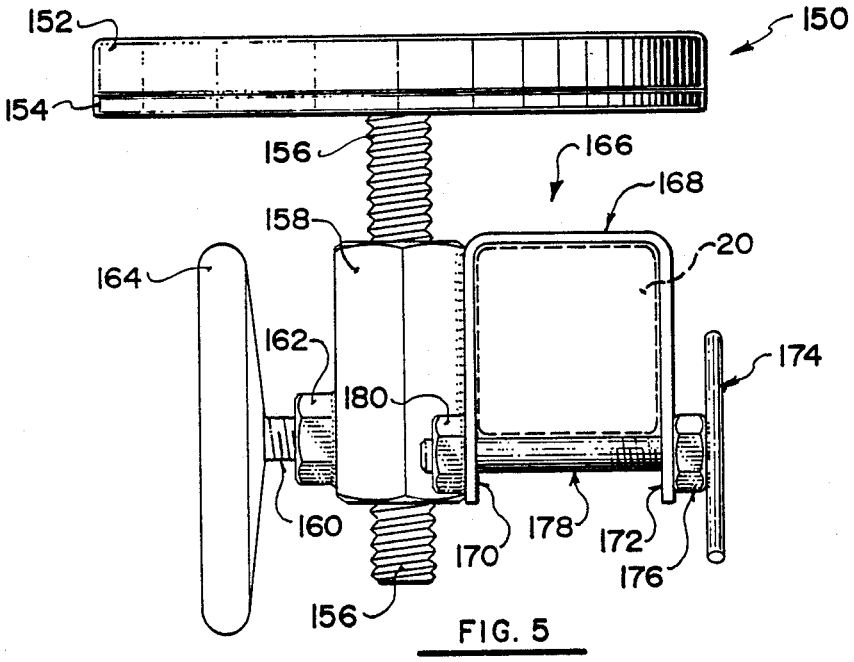
FIG. 5 shows an end view of an adjustable hand gun rest of the invention.

One embodiment 16, of the aft rest, (shown in FIGS. 1, 3, and 4) comprises paired opposed rubber bumpers 134 and 136, preferably neoprene, mounted on bolt 124, which passes through aft rest mount plate 122, outer fender Washers 138 and 140, and inner spacer washers 142 and 144 protect the bumpers, nut 146 secures bolt 124 in place, while nut 148 maintains bolt 120 similarly. The opposed bumpers are adapted to hold the butt portion of a rifle or similar firearm.

Figure 7:
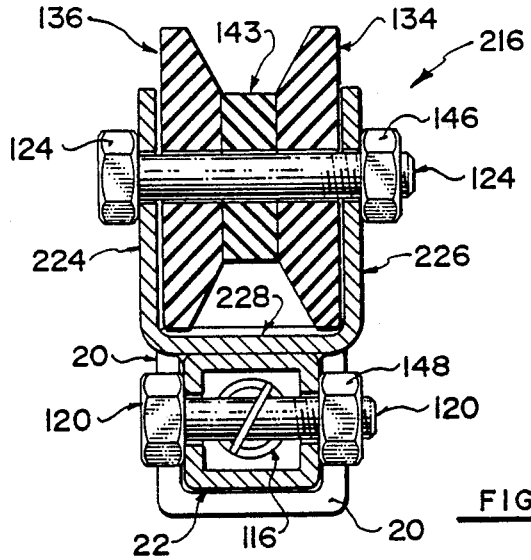
FIG. 7 shows a sectional view of an alternative embodiment of an aft rest mounting of the invention.

An alternative embodiment 216, of the aft rest, (shown in FIGS. 7 and 8) comprises U shaped aft rest plate 222, which as side walls 224 and 226 joined by bottom wall 228, itself welded to recoil slide 22, bolt 124 passes through side walls 224 and 226, paired opposed rubber bumpers 134 and 136, preferably neoprene, and inner spacer washer 143, nut 146 secures bolt 124 in place, while nut 148 maintains bolt 120 similarly. The opposed bumpers are adapted to hold the butt portion of a rifle or similar firearm, in the event that a weapon with a heavy recoil is utilized, spacer washer 148 prevents damage to the firearm butt.

Figure 6:
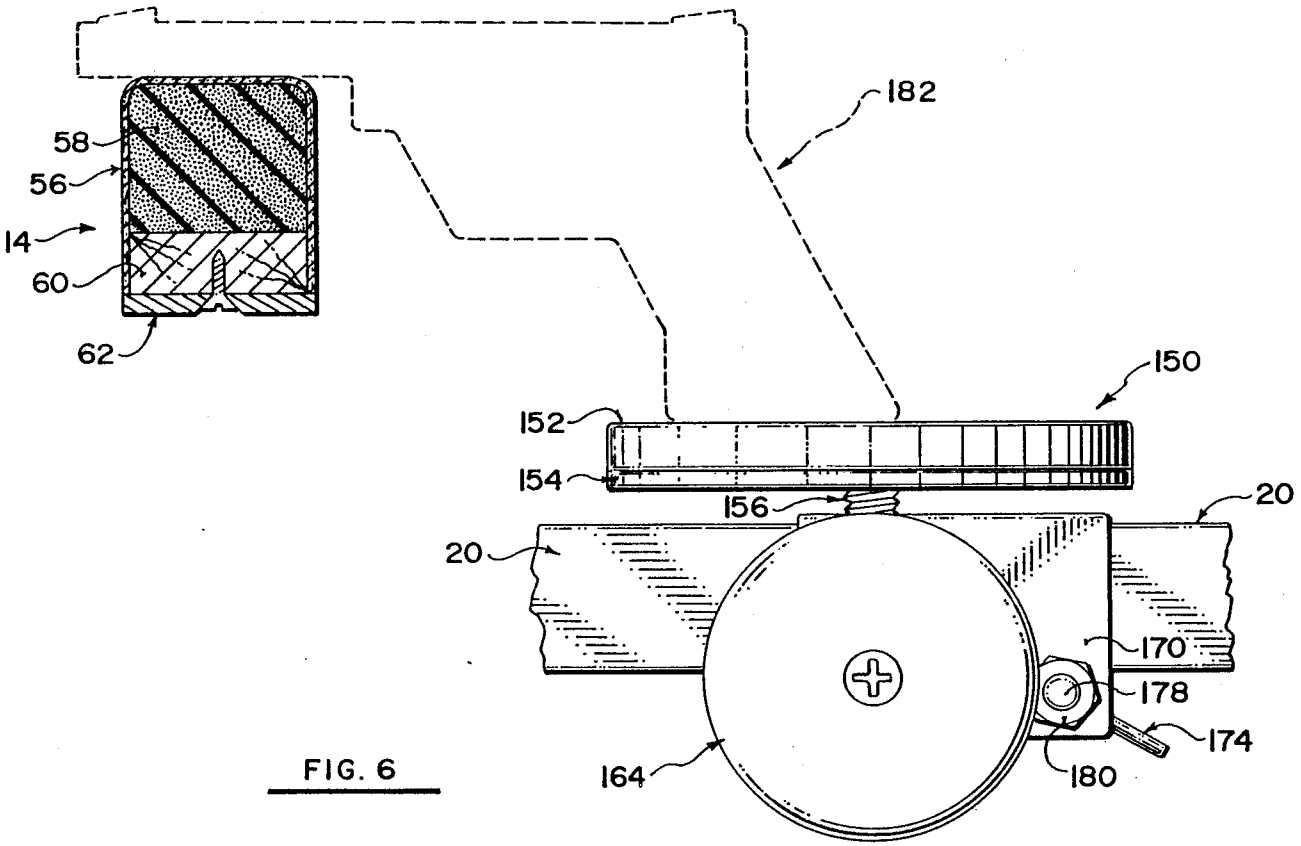
FIG. 6 shows a side view of an adjustable hand gun rest of the invention.

Adjustable hand gun rest 150, which is slidably and removably mountable on recoil guide 20, includes a butt rest cushion 152, preferably of foam rubber, mounted on circular plate 154, itself mounted on threaded rod 156, Which is threaded into coupling nut 158, set screw 160 is used to engage rod 156 in desired position, through hex nut 162 welded to coupling nut 168 and the wall of coupling nut 158, by turning knurled knob 1. Coupling nut 158 is welded to base mount 166, on side wall 170, which has top wall 168 and opposing side wall 172, these are dimensioned to fit recoil tube 20 externally. The opposing side walls 170 and 172 are utilized to grip or clamp recoil tube 20, rotation of handle 174, welded to bolt head 176, rotates bolt threaded rod 178 threaded through nut 180 welded to side wall 170, and moves side wall 170 toward or away from side wall 172, thus tightening or slackening the grip of mount 166 on recoil tube 20. The use of the hand gun rest is schematically indicated in FIG. 6, where hand gun 182 is indicated in outline with its barrel resting on fore rest 14, and its butt on adjustable hand gun rest 150.

In use nuts 90, 92, 94 and 96 are used to adjust the height of fore rest 14 above aft rest 16 to suit the particular rifle, carbine or similar weapon being fired. Then the rest is levelled with respect to the substrate, which may be virtually anything, but is preferably a relatively level surface, by level adjustment posts 24, 26, and 28. The tension adjustment of the recoil assembly is controlled by nut 108, while frictional adjustment can be made by set screw 128. The firearm at the moment of firing, recoils backwards dragging aft rest 16 and attached rear slide tube 22 backwards with respect to recoil guide tube 20, against the tension of spring 116, and the friction of set screw 128. After firing spring 116 pulls rear slide tube 22, aft rest 16 and the firearm forward to the original position. The base of the rest scarcely moves and can be used, for example, on the hood of a pick up truck without damaging the paintwork.

When a hand gun is used the shooter can use the adjustable hand gun rest. The hand gun rest with bolt rod 178 disengaged is placed on recoil tube 20, by fitting mount 166 over it, it is then slid along recoil tube 20 until a suitable position is reached. Bolt rod 178 is threaded through mount 166, and mount and hand gun rest are clamped in position by tightening bolt rod 178, by turning handle 174. The height of butt rest pad 152 is adjusted by rotating the rest until a suitable height is reached, when set screw 160 is used to engage rod 156 in position by turning knob 164.

Exemplary components and dimensions utilized in the preferred embodiments are indicated below, this is illustrative only, and certainly not by way of limitation.

The fore cross frame and recoil guide are made of 100 wall (1/10 inch), 1.25 inch square tubing, and the fore cross frame is 12 inches across, while the recoil guide is 16 inches long, the recoil slide is made of 125 wall ($\frac{1}{8}$ inch), 1 inch square tubing and is 16 inches long. The recoil adjusting means is a 6 inch$\times\frac{3}{8}$ inch threaded bolt, the recoil spring is a $\frac{3}{8}$ inch spring of suitable length, anchored by an anchor bolt which is $\frac{3}{8}$ inch in diameter. The friction control is a $\frac{3}{8}$ inch hex nut welded above a 7/16 inch hole with a $\frac{3}{8}$ inch nylon set screw in the hex nut, for adjustment. The coupling nuts are 2 inch long with $\frac{5}{8}$ inch diameter threads, the two fore adjustment posts are 6 inch$\times\frac{5}{8}$ inch, with hex nuts welded to the top and $\frac{5}{8}$ inch rubber cane tips on the bottom. The aft adjustment post is a $2\frac{3}{4}$ inch$\times\frac{5}{8}$ inch threaded rod with either a hex nut pinned $\frac{3}{8}$ inch above a rounded bottom, or a $\frac{5}{8}$ inch rubber cane tip slipped over it.

The fore rest is supported by two $\frac{3}{8}$ inch threaded rods secured to the fore cross frame by hex nuts, these rods engage hex nuts welded to a 12 inch$\times$2 inch by $\frac{1}{2}$ inch metal plate, above this is a spruce wood block 12 inch$\times$2 inch$\times\frac{3}{4}$ inch supporting a foam rubber pad 12 inch$\times$2 inch$\times$2 inch, covered with suede leather, three 1 inch No. 10 wood screws hold the wood block to the metal plate through holes drilled through the metal plate.

One embodiment of the aft rest (shown in FIGS. 1, 3, and 4) comprises a 1 inch$\times$2 inch$\times$5/16 inch rounded top metal plate, two $\frac{3}{4}$ inch thick, 3 inch diameter neoprene bumpers are mounted on the plate by a 5/16 inch machine bolt, the fender and spacer washers are $\frac{1}{4}$ inch thick In the alternate embodiment (shown in FIGS. 7 and 8) designed for heavier recoil firearms, the metal plate is U shaped and $\frac{1}{8}$ inch thick, 2 inch across at the bottom with side walls 1 7/8 inch high and extends $1\frac{1}{4}$ inch from front to rear, the bumpers are mounted internally on the bolt and are separated by a 5/16 inch rubber or neoprene washer.

As would be appreciated by those skilled in the art substantial substitution of materials is possible without effectively changing the function and structure of the invention.

Recoil is a major problem in zeroing firearms and in shooting at targets. The recoil thrust in foot pounds of felt recoil is given as $$[(B+P)\times P]/[G\times 80]$$

where B and P are the weight of bullet and powder in grains, and G is the weight of the gun in pounds. When the bullet is 175 grains, the powder is 63 grains, and the gun weighs 8.5 pounds, the recoil is given as 14494/680 or 22.05 foot pounds of recoil (this particular formula is given in P. O. Ackley, Volume II, Handbook for Shooters and Reloaders). Reduction of this recoil can be achieved by increasing gun weight, or by providing a recoil absorbing device. The recoil slide of the invention, adds about 2 pounds weight to the effective gun weight, reducing the recoil to 14994/840 or 17.85 foot pounds of felt recoil. The spring and the friction control further reduce the recoil effectively about another 2 foot pounds of recoil. This is a significant improvement in target shooting, and zeroing firearms.

Although this invention is described in terms of specific embodiments, it is not limited thereto, as would be understood by those skilled in the art, numerous variations are possible within the scope of the invention, without departing from the spirit and nature thereof.

I claim:

1. In a portable firearm rest comprising base means, fore rest means, aft rest means, a plurality of support post means projecting downward from said base means, said support post means being adapted to contact a substrate, said fore rest means being attached to fore rest support means mounted on said base means, the improvement comprising said fore rest means being fixedly mounted with respect to said base means, and said aft rest means being slidably mounted with respect to said base means, said aft rest means being attached to recoil slide means mounted slidably in recoil guide means in said base means, tension means including recoil spring means connecting said recoil slide means to said base means, whereby the recoil of a firearm mounted on said portable firearm rest is absorbed by said tension means.

2. The firearm rest of claim 1, wherein said tension means includes tension adjusting means for said recoil spring means.

3. The firearm rest of claim 2, wherein said base means comprises longitudinal aft frame means having fore and aft ends, said aft frame means including said recoil guide means, said recoil slide means having an aft portion projecting aft of said aft end of said recoil guide means said aft portion of said recoil slide means bearing said aft rest means.

4. The firearm rest of claim 3, wherein said base means comprises fore cross frame means having left and right ends and a midpoint, attached at said midpoint to said fore end of said longitudinal aft frame means, said tension adjusting means comprising threaded bolt means threadedly mounted within said fore cross frame means, said threaded bolt means extending inside said longitudinal aft frame means and said recoil guide means, said recoil spring means being attached to said threaded bolt means, and to anchor means mounted in said recoil slide means.

5. The firearm rest of claim 4, additionally comprising adjustable friction means between said recoil guide means and said recoil slide means.

6. The firearm rest of claim 5, wherein said adjustable friction means comprises set screw means threaded through said recoil guide means to contact said recoil slide means, whereby rotation of said set screw means applies pressure to said recoil slide means.

7. The firearm rest of claim 6, wherein said set screw means is plastic.

8. The firearm rest of claim 5 wherein said recoil guide means is longitudinal tube means forming said longitudinal aft frame means, and said recoil slide means is longitudinal tube means slidably received in said recoil guide means.

9. The firearm rest of claim 8, wherein said recoil guide means and said recoil slide means are square tubes, and said recoil slide means extends to the fore end of said recoil guide means in the forward position.

10. The firearm rest of claim 4, wherein said support post means are threaded posts rotatably threadably received in fore and aft coupling nuts, and fore coupling nuts being attached to said fore cross member adjacent the ends thereof, said aft coupling nut being attached to said longitudinal aft frame means adjacent the aft end thereof, whereby said plurality of support post means are adjustable in height.

11. The firearm rest of claim 10, wherein said threaded posts received in said fore coupling nuts include resilient substrate contact means.

12. In a portable firearm rest comprising base means, a plurality of support post means projecting downward from said base means, said support post means being adapted to contact a substrate, fore rest means attached to fore rest support means mounted on said base means, the improvement comprising aft rest means attached to recoil slide means mounted slidably in recoil guide means including in said base means, tension means including recoil spring means connecting said recoil slide means to said base means, whereby the recoil of a firearm mounted on said portable firearm rest is absorbed by said tension means, said base means comprises longitudinal aft frame means having fore and aft ends and fore cross frame means having left and right ends and a midpoint, attached at said midpoint to said fore end of said longitudinal aft frame means, said longitudinal aft frame means comprising said recoil guide means, said recoil side means having an aft portion projecting aft of said aft end of said recoil guide means, said aft portion of said recoil means bearing said aft rest means, said tension means comprising threaded bolt means threadably mounted within said fore cross frame means, said threaded bolt means extending inside said aft longitudinal frame and said recoil guide means, said recoil spring means being attached to said threaded bolt means, and to anchor means mounted in said recoil slide means, said plurality of support post means comprising left and right threaded post means rotatably threadably received in fore coupling nuts attached to fore cross frame means adjacent the ends thereof, and aft threaded post means rotatably threadably received in aft coupling nut means attached to said longitudinal aft frame means adjacent the aft end thereof, adjustable friction means between said recoil guide means and said recoil slide means, said friction means comprising set screw means threaded through said recoil guide means to contact said recoil slide means, said recoil guide means being longitudinal square tubing forming said longitudinal aft frame means, and said recoil slide means is longitudinal square tubing means slidably received in said recoil guide means, said recoil slide means extending to the fore end of said recoil guide means in the forward position, said fore rest support means comprising fore rest support post means mounted on said fore cross frame means, fore rest plate means attached to said fore rest support post means, resilient transverse pad means mounted on said fore rest plate means, said right, left and aft threaded post means including resilient substrate contact means.

13. The firearm rest of claim 12, wherein said aft rest means comprises aft mount plate means mounted vertically on said recoil slide means, opposed resilient bumpers mounted on opposed side faces of said aft mount plate means secured to said aft mount plate means by bolt means passing through said bumpers and said aft mount plate means.

14. The firearm rest of claim 12, wherein said aft rest means comprises U shaped aft mount plate means mounted vertically on said recoil slide means, said aft plate mount means comprising opposed side walls, opposed resilient bumpers mounted internally on said opposed side walls secured to said side walls by bolt means passing through said bumpers and said side walls.

15. A hand gun butt rest demountably attached to the base means of claim 1 comprising generally horizontal hand gun butt support means, base mount means, post means connecting said support means to said base mount means, and means to clamp said base mount means demountably to said portable firearm base means, whereby a hand gun can be rested on said fore rest means at the barrel, and on said hand gun butt support means at the butt.

16. A hand gun butt rest demountably attached to said longitudinal aft frame means of claim 3, comprising hand gun butt support means, base mount means, post means connecting said support means to said base mount means, and means to clamp said base mount means demountably to said portable firearm longitudinal aft frame means, whereby a hand gun can be rested on said fore rest means at the barrel, and on said hand gun butt support means at the butt, said post means being adjustable so that the height of said hand gun butt support means above said base mount is adjustable.

17. A hand gun butt rest demountably attached to said longitudinal aft frame means of claim 13, comprising a resilient pad mounted upon a pad support plate, said pad support plate being mounted upon vertical post means comprising threaded rod means rotatably mounted in coupling nut means, set screw means rotatably mounted in the side of said coupling nut means, base mount means comprising a top wall connecting opposed downward side walls, said coupling nut means being attached to one of said downward side walls, whereby rotation of said threaded rod means adjusts the height of said pad support plate above said coupling nut means, and rotation of said set screw means locks said threaded rod means in position, demountable operating screw means comprising handled threaded bolt means, passing through a first unthreaded aperture in a first side wall and a second aperture in a second side wall and being rotatably threadably received in said second side wall, whereby rotation of said handled threaded bolt means adjusts the distance between said downward side walls to allow clamping onto said longitudinal aft frame means.

18. A hand butt rest demountably attachable to a portable firearm rest having fore rest means and base means, said hand gun butt rest comprising generally horizontal hand gun butt support means, base mount means, post means connecting said support means to said base mount means, and means to clamp said base mount means demountably to said portable firearm base means, whereby a hand gun can be rested on said fore rest means at the barrel, and on said hand gun butt support means at the butt.

19. The hand gun butt rest of claim 18, wherein said post means are adjustable so that the height of said hand gun butt support means above said base mount means is adjustable.

20. The hand gun butt rest of claim 19, wherein said hand gun butt support means comprises a resilient pad mounted upon a pad support plate, said pad support plate being mounted upon vertical post means comprising threaded rod means rotatably mounted in coupling nut means, set screw means rotatably mounted in the side of said coupling nut means, said base mount means comprising a top wall connecting opposed downward side walls, said coupling nut means being attached to one of said downward side walls, whereby rotation of said threaded rod means adjusts the height of said pad support plate above said coupling nut means, demountable operating screw means comprising handled threaded bolt means, passing through a first unthreaded aperture in a first side wall and a second aperture in a second side wall and being rotatably threadably received said second side wall, whereby rotation of said handled threaded bolt means adjusts the distance between said side walls to allow clamping onto said portable firearm rest.

* * * * *